US006124536A

United States Patent [19]

Hoshino

[11] Patent Number: 6,124,536

[45] Date of Patent: Sep. 26, 2000

[54] BRIDGE MECHANISM FOR THE ACOUSTIC GUITAR

[75] Inventor: Yoshihiro Hoshino, Nagoya, Japan

[73] Assignee: Hoshino Gakki Co., Ltd., Japan

[21] Appl. No.: 09/368,962

[22] Filed: Aug. 5, 1999

[30] Foreign Application Priority Data

Dec. 24, 1998 [JP] Japan ..... 10-367441

[51] Int. Cl.[7] ..... G10D 3/04

[52] U.S. Cl. ..... 84/298; 84/307

[58] Field of Search ..... 84/298, 299, 267, 84/307

[56] References Cited

U.S. PATENT DOCUMENTS 5,347,905 9/1994 Cipriani ..... 84/298

5,355,759 10/1994 Hoshino .

*Primary Examiner*—Stanley J. Witkowski

*Assistant Examiner*—Shih-yung Hsieh

*Attorney, Agent, or Firm*—Ostrolenk, Faber, Gerb & Soffen, LLP

[57] ABSTRACT

A bridge mechanism for an acoustic guitar for fine adjustment of the height and length of the strings. The bridge mechanism is installed on a thin installation plate that is wider laterally than the width occupied by the array of guitar strings. The installation plate is installed directly on the surface of the soundboard. The installation plate has a plurality of string stopper holes and has a concave region on its top surface. A base plate has a plurality of screw holders and is fixed in the concave region. The base plate is arranged in such a way as to correspond to the guitar strings, but does not overlap with the guitar strings. Bridge members are arranged individually and independently for each guitar string. Each has a string holder and each is freely movable back and forth via a string length adjusting screw. The bridge members are also freely movable up and down through a string height adjusting screw. A respective fixing pin fixes each guitar string in a string stopper hole.

5 Claims, 6 Drawing Sheets

BRIDGE MECHANISM FOR THE ACOUSTIC GUITAR

BACKGROUND OF THE INVENTION

1. Field of the Related Art

This invention relates to a bridge mechanism for an acoustic guitar.

2. Description of the Related Art

A prior art acoustic guitar 60, such as a folk guitar, is shown in FIG. 7. A hollow resonant box 70 amplifies the vibrating sound of the strings under the table or soundboard 62 of the guitar body 61. The resonant box 70 is completed by back 63 and side plate 64.

Guitar strings 65 are installed at a pedestal or tailpiece 68 that is fixed to the surface of the soundboard 62. The end of each string is held by means of a wedge-like fixing pin 69. The string is rolled onto a tuning bolt or peg 67 at the other end of neck 66.

In contrast to the acoustic guitar, in an electric guitar the vibrations of the strings are picked-up and amplified electronically, using a magnetic force generated by the vibrating strings. Accordingly, the body of an electric guitar ordinarily is solid and is equipped with a bridge mechanism comprising a base plate made of a metal and a plurality of bridge members (saddle members) made of metal as are described in the Official Publication of Utility Model Registration No. 2560349, to cite an example.

As in the case of the above-described acoustic guitar, the guitar strings of the electric guitar are held at the bridge member of the bridge mechanism at one end and rolled onto the tuning bolt of the neck at the other end. In electric guitar bridge members individual adjustment of the string height and length are possible, as compared with the base plate. The string height and length normally are capable of very fine adjustment.

In the acoustic guitar, on the other hand, it is not possible to make a fine adjustment of the string height and the string length. Accordingly, performers accustomed to an electric guitar, which has become the main form of guitar in use in recent years, tend to complain about this lack of fine string adjustment in acoustic guitars. In addition, if it becomes possible to make a fine adjustment of the string height and the string length of an acoustic guitar, the breadth of its performance capabilities will be expanded.

Nevertheless, loading an acoustic guitar with a bridge mechanism that is capable of affording a fine adjustment of the height and the length of each guitar string entails the following problems:

The surface of the soundboard of the acoustic guitar has normal curvature with a radius approximately in the range between 4000 and 6000 millimeters. Variations in the curved surface stem from such natural conditions as the manufacturing requirements and the humidity, etc. But this makes it extremely difficult to adhere a base plate made of metal tightly to the surface of the soundboard.

Further, if the base plate does not adhere tightly to the surface of the soundboard, the vibrations of the guitar strings are not transmitted accurately to the guitar body, and there are other undesirable sounds, etc. that are produced, thereby reducing the quality of the sound, for example.

Even when a base plate made of metal has been tightly fixed to the surface of the soundboard, the soundboard tends to be deformed in the horizontal direction as compared with the guitar strings because of changes in the temperature or humidity, so that the tight adherence between the soundboard and base plate tending to deteriorate and deform the instrument.

SUMMARY OF THE INVENTION

The present invention overcomes the problems of the prior art, such as those noted above, by providing a bridge for an acoustic guitar wherein it becomes possible to make a fine adjustment of the string height and string length for the acoustic guitar. The bridge is capable of simple and secure installation tightly on the surface of the soundboard, even if there are variations in the surface curvature.

The invention provides a bridge for an acoustic guitar that has a hollow resonant box under the soundboard of a guitar. An installation plate, preferably wider than the guitar strings, is secured to the soundboard surface. A plurality of string stopper holes corresponding to the various guitar strings are provided in the installation plate.

A base plate is provided in a concave portion of the installation plate. The base plate has a plurality of screw holding parts. The screw holding parts are arranged at such positions as would correspond to, and not overlap with, the guitar strings.

A plurality of bridge members are arranged individually and independently for each guitar string. Each bridge member has a string holding part for the corresponding guitar string. The bridge member is held so as to be freely movable back and forth through an adjusting screw that has been inserted into the screw holding part for adjusting the length, or intonation, of the string. Also, the bridge members are held in such a manner as to freely move up and down through an adjusting screw whose lower end contacts the upper surface of the base plate for adjusting the height, or action, of the string.

A plurality of pins fix the various guitar strings held by the string holding part of the bridge member integrally in the string stopper hole.

In a preferred embodiment of the inventive bridge mechanism for the acoustic guitar, the installation plate and the base plate are fixed to the surface of the soundboard by means of a common screw member.

Preferably, the length of the installation plate in the horizontal direction is more than twice the length of the base plate in the horizontal direction. In addition, the height of the entire bridge mechanism as it protrudes from the surface of the soundboard preferably does not exceed 15 millimeters.

Other features and advantages of the present invention will become apparent from the following description of the invention which refers to the accompanying drawings.

DETAILED DESCRIPTION OF THE PREFERRED EMBODIMENTS

Figure 1:
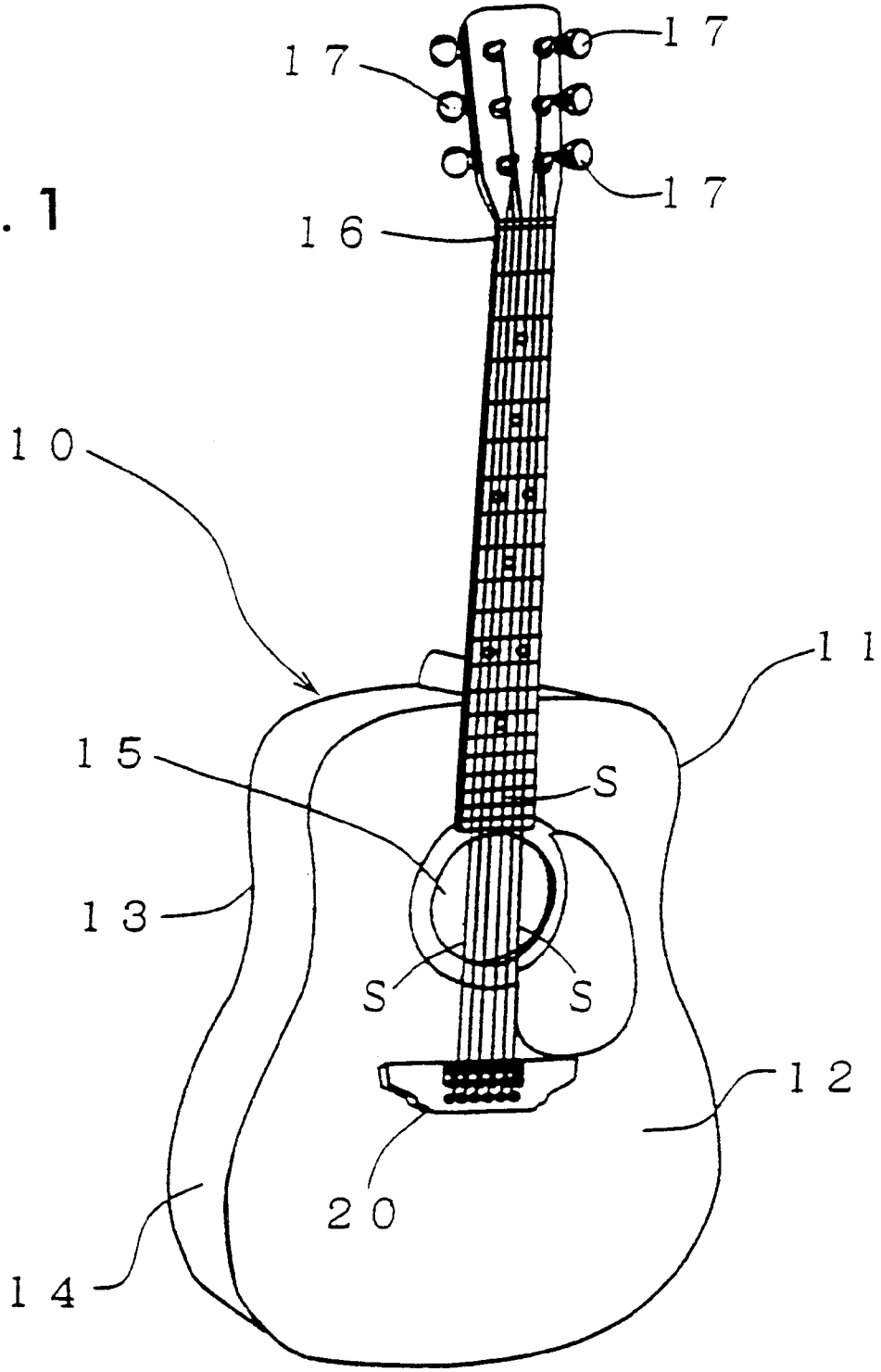
FIG. 1 is a plan view showing an acoustic guitar equipped with a bridge mechanism according to the present invention.

The acoustic guitar shown in FIG. 1 generates sounds through the resonance of the guitar body 11. It has a hollow resonance box 15 for sound amplification comprised of a back 13 and a side plate 14 on the bottom side of the soundboard. A plurality of guitar strings S (six in the example shown in the drawing) are held by tuning bolts or pegs 17 of the neck 16 at one end. The strings are held at the other end by a bridge mechanism 20 arranged on the soundboard 12.

Figure 2:
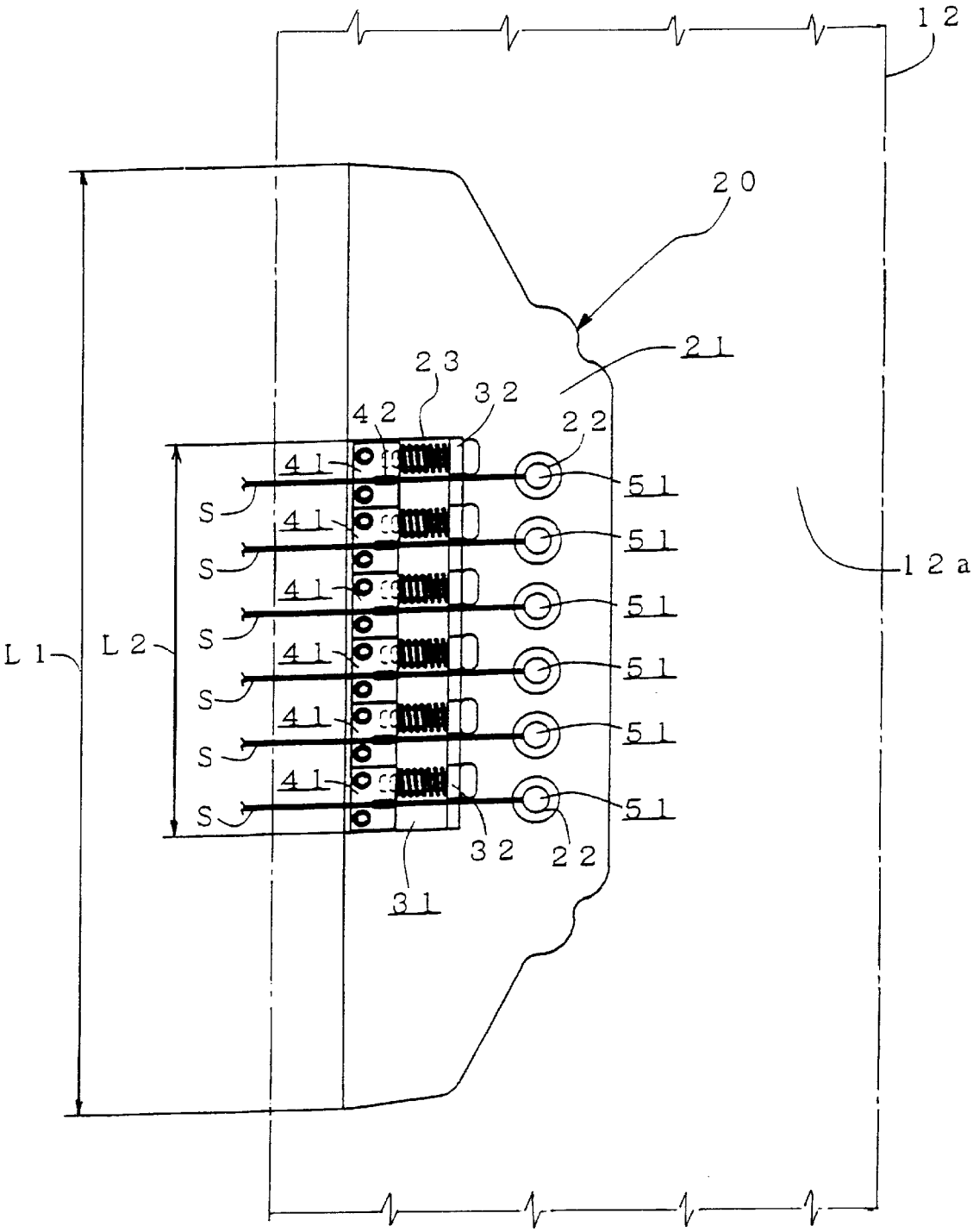
FIG. 2 is a plan view showing details of a bridge mechanism according to the present invention.
Figure 3:
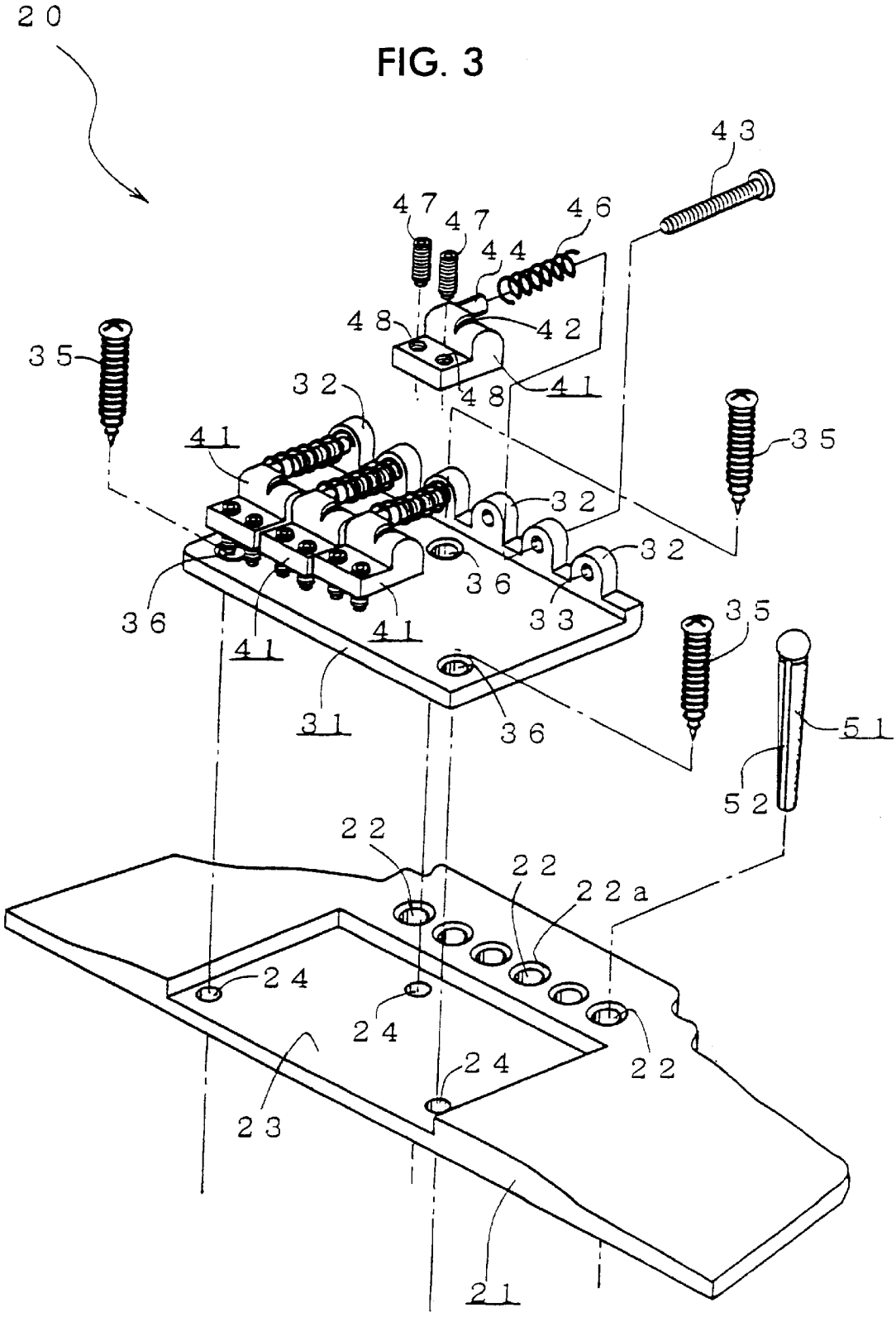
FIG. 3 is an exploded perspective view of the bridge mechanism of FIG. 2.
Figure 4:
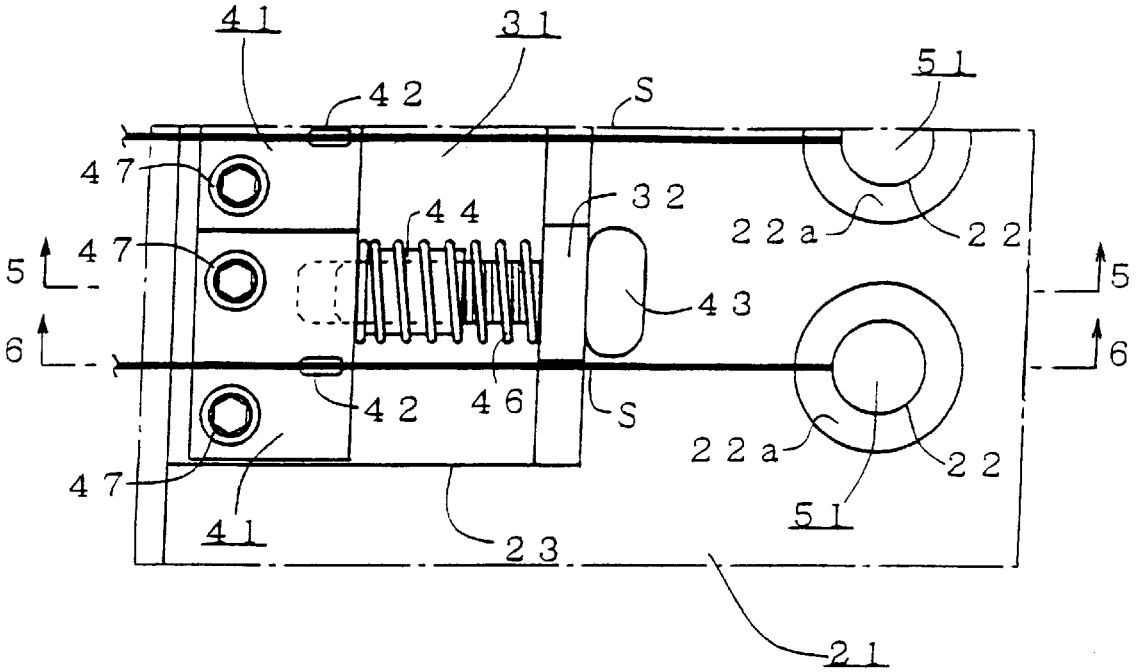
FIG. 4 is a close-up detailed view of the bridge mechanism of FIG. 2.

An example of the bridge mechanism 20 according to the present invention is explained below. Bridge mechanism 20 holds and fixes the strings S in such a manner as to make it possible to carry out fine adjustment of the string height and string length for each of the guitar strings. As shown in FIGS. 2–4, the bridge mechanism comprises an installation plate 21, a base plate 31, a plurality of bridge members 41, and a plurality of fixing pins 51.

Installation plate 21 is used to install the bridge mechanism 20 to the guitar body 11. Installation plate 21 is thin; and extends wider laterally across the soundboard as compared with the array of guitar string S. The back or undersurface of the installation plate is fixed adjacent to the upper surface 12*a* of the soundboard 12 of the body 11, as described further below.

The flexibility of the installation plate 21 generally increases as the thickness of the installation plate 21 is reduced. In connection with the expansion of the soundboard 12 of the guitar body 11 in the lateral direction, due to variations in the temperature or humidity, for example, the installation plate 21 tends to follow the expansion of the soundboard 12. The installation plate 21 is made of such a substance as to have some kind of elasticity (flexibility), and it is made of wood in this example. Of course, it is not limited to this. The installation plate 21 can be made of a plastic, as well as other natural or synthetic polymers and materials.

At the bottom part of the installation plate 21, further, a plurality of string stopper holes 22 are provided. The stopper holes have a tapered surface 22*a*, and there is one for each guitar string S.

There is a concave region 23 is formed in the top of the plate 21 above or in front of the string stopper holes 22. In this example, a plurality (three are shown) of fixing holes 24 are formed in the concave part 23.

The base plate 31, made of metal, is fixed in the concave region 23 of the installation plate 21. In this example, the base plate 31 is fixed along with the installation plate 21 to the surface of the soundboard 12 of the guitar body 11 by common screws 35. The screws are installed through respective fixing holes 36 formed in the base plate 31. Consequently. the number of parts involved is reduced, and the installation strength between the guitar body 11 and the bridge mechanism 20 is increased.

In FIG. 2, the lateral width L1 of the installation plate 21 is more than twice the width L2 of the base plate 31 in the same lateral direction. In particular, the width L1 of the installation plate 21 is 150 millimeters while the width L2 of the base plate 31 is 63.5 millimeters. Accordingly, the installation plate 21 is sufficiently strong, and has increased flexibility (elasticity) in the horizontal direction.

There are a plurality of screw holders 32, e.g., six provided at the bottom of the base plate 31 corresponding to each guitar strings S. Each screw holding part 32 has an opening 33 for receiving a screw. The screw holding parts are positioned to avoid overlap or interference with the guitar strings S.

Guitar strings S are supported by bridge members 41 which are above the screw holding parts 32. Bridge members 41 are preferably made of a metal, and are provided individually and independently for each guitar string S on the base plate 31. Bridge member 41 has a string holding part (string contact part) for the guitar string S. The string holding part 42 in this example is provided as a groove in the shape of a curved surface.

Moreover, each bridge member 41 is held on the base plate 31 so as to be freely movable back and forward through action of a respective string length adjusting screw 43. Each adjusting screw 43 is threaded through the opening 33 of the respective screw holding part 32. Each bridge member also is held by the base plate 31 and is freely movable up and down through a number of string height adjusting screws 47 (two of them in this example) for each bridge member, where the bottom ends of the screws contact the upper surface of the base plate 31.

Figure 5:
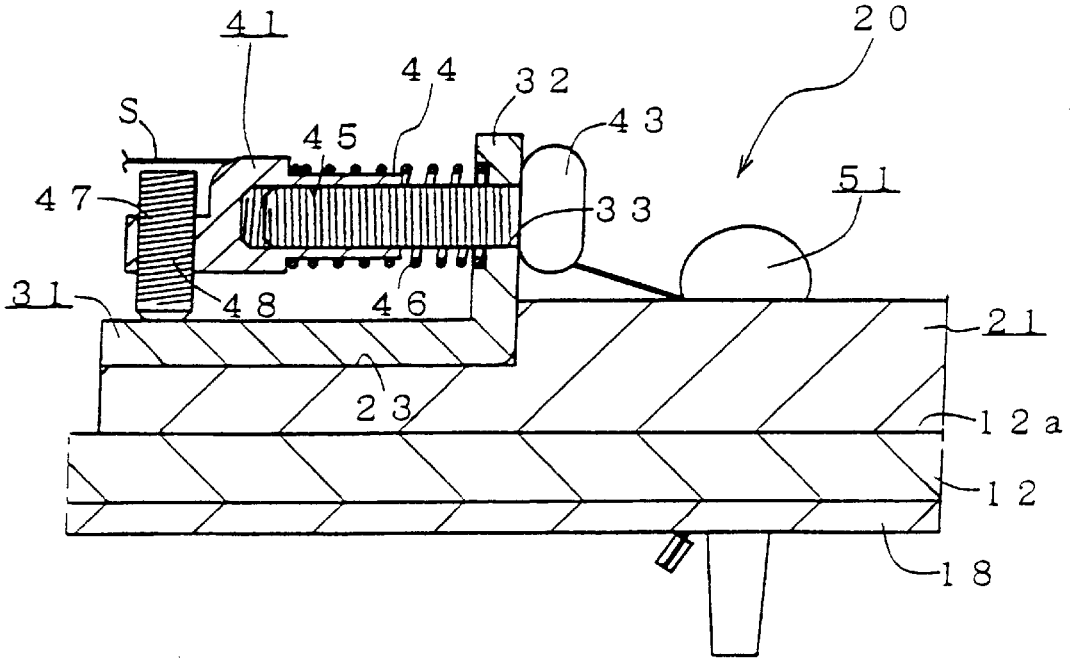
FIG. 5 is a cross-section taken along line 5—5 in FIG. 4.

Referring to FIGS. 4 and 5, there is an installation part 44 for the string length adjustment screw. The part 44 includes screw hole 45. It is provided on one side of the string holding part 42 of the bridge member 41. The string length (back and forth) adjusting screw 43 is screwed into the bridge member 41 through the installation part 44.

A spring 46 around the adjusting screw 43 provides tension on that screw 43 and biases the bridge member 41 away from screw holder 32. The installation part 44 accommodates the screw 43. A respective screw hole 48 accommodates each up and down adjusting screw 47.

Each guitar string S that is held by the string holding part 42 of the bridge member 41 is integrally fixed in the string stopper hole 22 by a fixing pin 51. Fixing pin 51 is a wedge like body, made of a plastic or wood, for example. In the preferred embodiment shown, a known fixing pin 51 includes a cut 52 in the axial direction for accommodating the string. One end of the guitar string S is inserted into the string stopper hole 22 along with fixing pin 51, so that the guitar string S is held between the tapered surface 22*a* of the string stopper hole 22 and the fixing pin 51. A bridge plate 18 (bridge pad) beneath the plate 21 is provided for re-enforcing the surface of the soundboard 12.

The bridge mechanism 20 described above is installed on the surface 12*a* of the soundboard 12 of the guitar body 11 through the installation plate 21. Upon variations in the curved surface of the soundboard 12, due to the manufacturing conditions and such natural conditions as humidity, etc., the form of the installation plate 21 can be changed accordingly. Accordingly, it is possible to install the plate tightly on the surface 12*a* of the soundboard 12 in a simple fashion. At the same time, the installation will have a high level of strength and stability.

Even when the soundboard 12 may be deformed laterally, as compared with the guitar strings S, after the installation of the bridge mechanism 20 on the surface 12*a* of the soundboard 12 due to variations in the temperature or humidity, etc., the installation plate 21 is sufficiently flexible to follow the deformation. This makes it possible to prevent any deterioration of the tight adhesion between the bridge mechanism 20 and the soundboard 12. Since the base plate 31 is fixed in the concave region 23 that has been formed on the installation plate 21, it becomes possible to control the maximum protrusion height above the surface 12*a* of the soundboard 12 of the bridge mechanism 20 as a whole.

Figure 6:
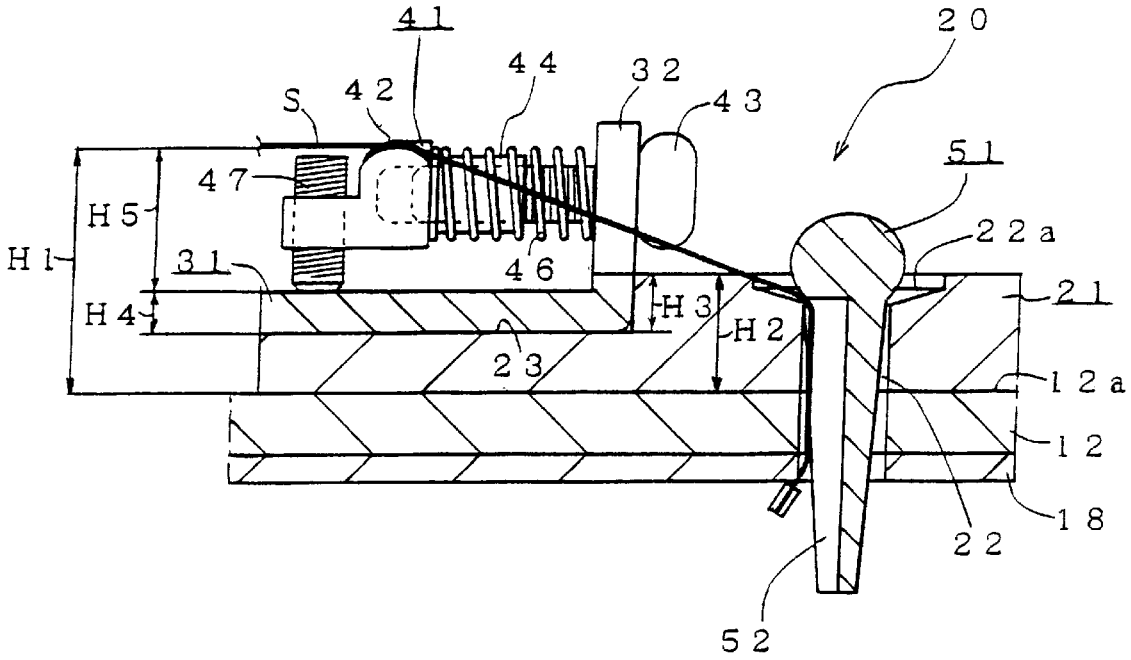
FIG. 6 is a cross-section taken along line 6—6 in FIG. 4.
Figure 7:
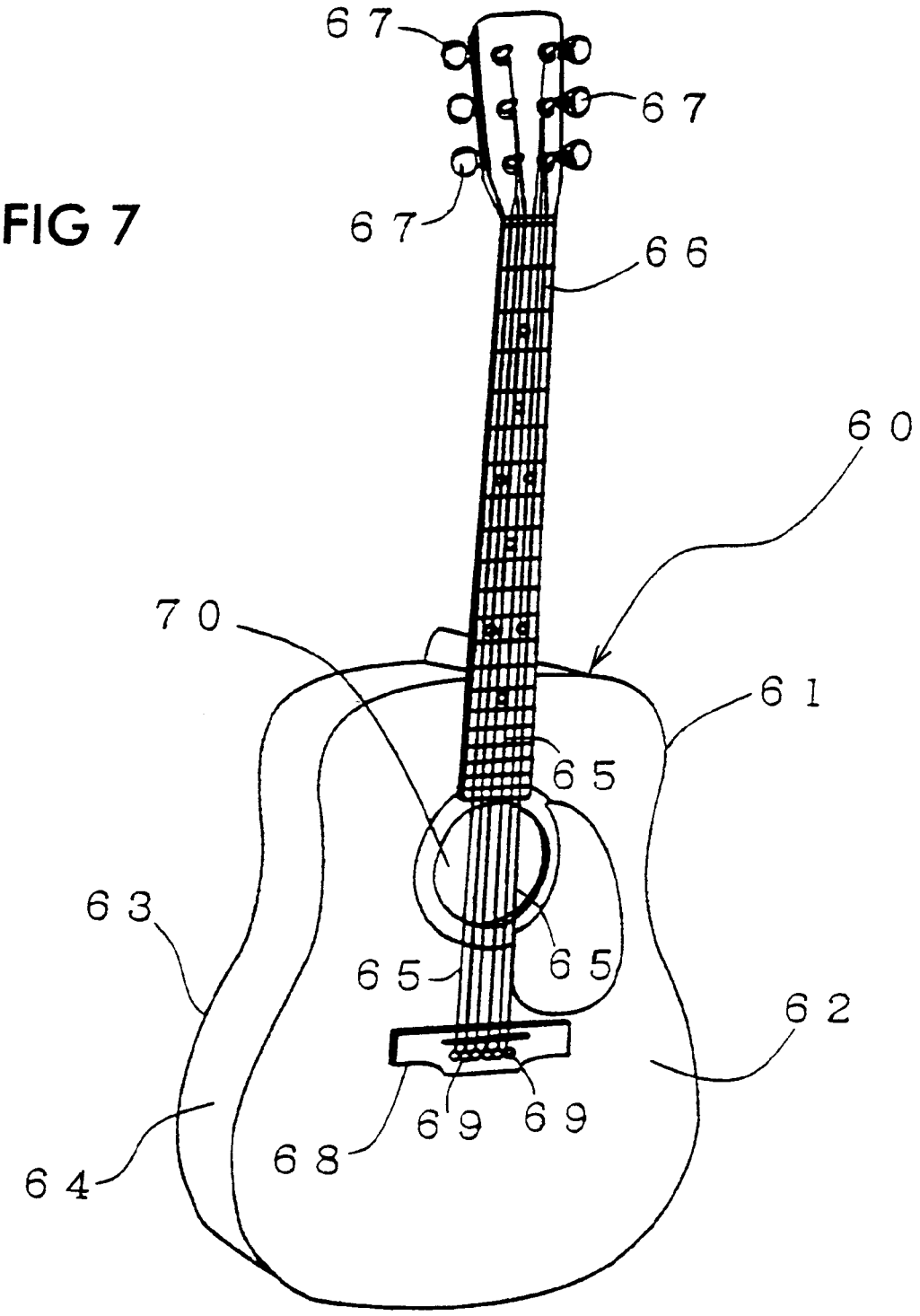
FIG. 7 is a front view of an acoustic guitar according to the prior art.

Preferably, the height of the protrusion of the bridge mechanism 20 as a whole from the surface 12*a* of the soundboard 12 is to not exceed 15 millimeters. In a preferred embodiment of FIG. 6, the thickness H2 of the installation plate 21 is six millimeters, the depth H3 of the concave part 23 of the installation plate 21 is three millimeters, and the thickness of the base plate 31 is two millimeters. The height H5 of the highest position of the bridge member 41 from the top surface of the base plate 31 to the string holding part 42 is 10 millimeters. Accordingly, the height H1 (=H2 +H4+ H5-H3) of the protrusion of the bridge mechanism 20 from the surface 12*a* of the soundboard 12 is 15 millimeters.

To adjust the string height or string length of each guitar string S, the fixing pin 51 is first loosened in its string stopper hole 22, which sets free the guitar string S held by the string holding part 42 of the bridge member 41. The string height is adjusted up and down by turning adjusting screw 47 accordingly. The length of guitar string S, on the other hand, is adjusted by turning the string length (back and forth) adjusting screw 43 such that the screw length against the bridge member 41 is changed, thereby adjusting the position of the bridge member 41 along the string. After adjustment of the height or the back and forth position of the bridge member 41, the guitar string S is again fixed in the string stopper hole 22 by the fixing pin 51.

The bridge mechanism 20 can be provided on various kinds of acoustic guitars, thereby improving the guitar's general purpose characteristics. The ability to carry out fine adjustment of the string height and the string length of the guitar strings and the fine adjustment of the string height, in particular, increases the breadth of the performance capabilities of the acoustic guitar. At the same time, the following advantages are achieved:

Since the soundboard 12 in the acoustic guitar 19 is a thin plate with a thickness, preferably in the range between 2.5 and 3.0 millimeters, in accordance with its function as a resonant box, the soundboard 12 may be deformed in the vertical direction as compared with the guitar strings because of the tension of the guitar strings. As a result, the height of the surface 12*a* of the soundboard 12 and, consequently, the height of the guitar string S, will vary. With the present invention, however, the height of the guitar string S can be restored to a desired height as described above by the string height adjustment.

In addition, it is possible to independently effect fine adjustment of the string height and string length of the guitar strings for each string. Therefore, an acoustic guitar can be provided which can satisfy even those performers who have been accustomed to an electric guitar.

Moreover, the installation plate preferably is thin and long in the lateral direction as compared with the lateral array of guitar strings, and can be tightly installed on the surface of the soundboard in a simple fashion, and satisfactorily strong, even in the presence of variations in such natural conditions as the temperature or humidity, in addition to the manufacturing requirements on the surface of the soundboard.

By providing an installation plate preferably having a lateral width that is more than twice the width of the base plate, moreover, it becomes possible not only to set the strength of the installation plate sufficiently high but the flexibility of the installation plate in the lateral direction can also be elevated, thereby further increasing the installation strength of the bridge mechanism on the guitar body.

Also, by providing a bridge mechanism having a height as a whole that protrudes from the surface of the soundboard preferably less than about 15 millimeters, it is possible for the bridge mechanism to be carried on various kinds of acoustic guitars, thereby increasing its general purpose capability.

Although the present invention has been described in relation to a particular embodiment, many other variations and modifications and other uses will become apparent to those skilled in the art. It is preferred, therefore, that the present invention be limited not by the specific disclosure herein, but only by the appended claims.

What is claimed is:

1. A bridge mechanism for an acoustic guitar having guitar strings and a hollow resonant box under the soundboard of a guitar, the bridge mechanism comprising:

an installation plate secured to the soundboard surface, the installation plate having a plurality of string stopper holes corresponding to the various guitar strings and having an outward surface with a concave region in the outward surface;

a base plate having a plurality of screw holders, the base plate being fixed in the concave region of the installation plate, the screw holders being arranged at positions that would correspond to the various guitar strings and would not overlap with the guitar strings;

a plurality of individual and independent bridge members against which the guitar strings rest, each bridge member having a string holder for the guitar string, each bridge member being held freely movable forward and back and through an adjusting screw inserted into the screw holder, each bridge member also being freely movable up and down through an adjusting screw having a lower end that contacts the upper surface of the base plate.

2. The bridge mechanism for an acoustic guitar of claim 1, wherein the installation plate and the base plate are fixed to the soundboard by means of a common screw member.

3. The bridge mechanism for an acoustic guitar of claim 1, wherein the installation plate is wider laterally more than twice the width laterally of the base plate.

4. The bridge mechanism for an acoustic guitar of claim 1, wherein the height of the entire bridge mechanism from the surface of the soundboard does not exceed 15 millimeters.

5. The bridge mechanism for an acoustic guitar of claim 1, further comprising a respective pin for fixing a guitar string held by the string holder of the bridge member integrally in the respective string stopper hole.

* * * * *